United States Patent [19]

Clausen

[11] 4,343,291

[45] Aug. 10, 1982

[54] FRICTION HEAT GENERATOR

[76] Inventor: Robert L. Clausen, 1912 Pound Hill Rd., R.F.D. #1, Woonsocket, R.I. 02895

[21] Appl. No.: 142,108

[22] Filed: Apr. 21, 1980

[51] Int. Cl.[3] ..... F24C 9/00

[52] U.S. Cl. ..... 126/247; 122/26

[58] Field of Search ..... 126/247; 122/26; 237/12.1; 165/89; 416/146 R, 178

[56] References Cited

U.S. PATENT DOCUMENTS

| | | | |
|---|---|---|---|
| 1,228,215 | 5/1917 | Junkers | 122/26 |
| 1,598,289 | 8/1926 | Lee | 122/26 X |
| 1,650,612 | 11/1927 | Denniston | 126/247 X |
| 2,344,075 | 3/1944 | Beldimano | 126/247 |
| 3,164,147 | 1/1965 | Love et al. | 126/247 |

FOREIGN PATENT DOCUMENTS

| | | | |
|---|---|---|---|
| 371529 | 10/1920 | Fed. Rep. of Germany | 122/26 |
| 7604596 | 11/1977 | Netherlands | 416/146 R |

*Primary Examiner*—Samuel Scott
*Assistant Examiner*—Randall L. Green
*Attorney, Agent, or Firm*—Salter & Michaelson

[57] ABSTRACT

A friction heat generator in which opposed inner and outer cylinders are each provided with a plurality of pins. The pins extend into a chamber formed by reason of the spaced relationship of the cylinders. A heat exchange fluid such as a high-boiling point liquid in one embodiment and water in an other embodiment is contained in such chamber. Rotation of the inner cylinder with respect to the outer cylinder causes the projecting pins to move past each other so as to impart an agitation or churning to the fluid thus creating frictional heat.

4 Claims, 6 Drawing Figures

FIG. 1
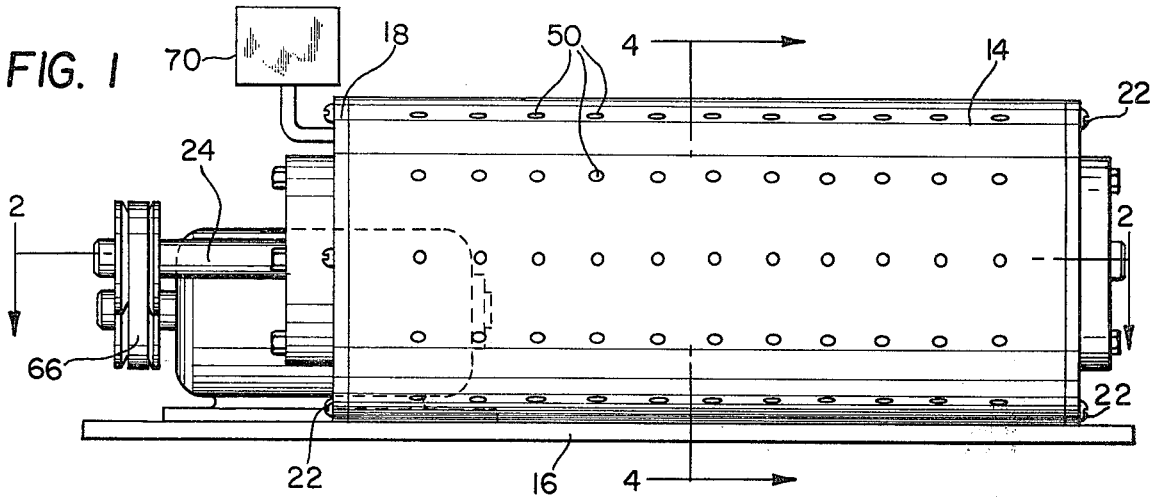
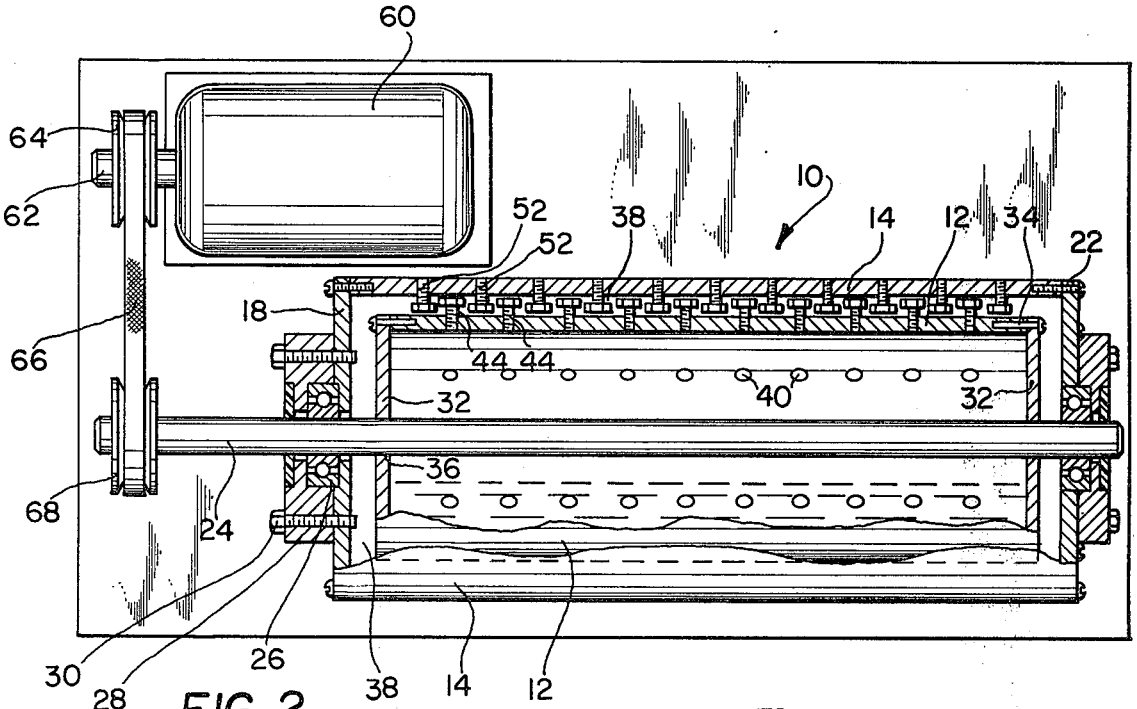
FIG. 2
FIG. 3
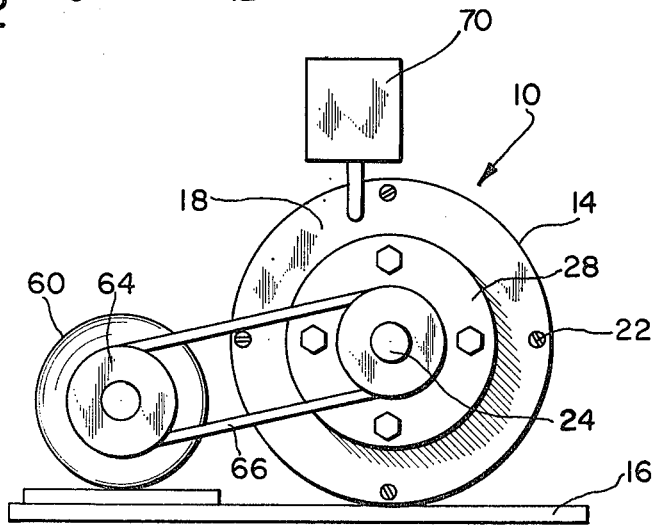

FRICTION HEAT GENERATOR

BACKGROUND AND SUMMARY OF THE INVENTION

This invention relates to a friction heat generator and more particularly to such a device constructed in a unique manner so as to achieve efficient heat generation in a trouble-free manner.

Various friction heat generator constructions have been proposed in the past; for instance, those shown by the following U.S. Pat. Nos. 361,164, KILBOURN, issued Apr. 12, 1887; 1,126,354, BECKER, Issued Jan. 26, 1915; 1,366,455, HENSON, issued Jan. 25, 1921; 1,682,102, ALLEN, issued July 19, 1926; 1,758,207, WALKER, issued May 26, 1928, 2,226,423, BLACK, issued Oct. 4, 1939; 3,683,448, SMITH issued July 12, 1951; 3,198,191, WYSZOMIRSKI, issued Aug. 3, 1965. Such proposed constructions are either overly complex or require periodic parts replacement or the use of components which are difficult to machine or otherwise form and accordingly expensive. The need, accordingly, still exists for an improved friction heat generator which operates at a high efficiency, is easy to assemble and operate and which can be formed from universally available components and thus can be produced at a reasonable cost.

It is accordingly a primary object of the present invention to provide an improved construction friction heat generator which accomplishes the above indicated desirable features yet which avoids prior art drawbacks. These and other objects of the present invention are accomplished by the provision of a friction heat generator comprising an inner cylinder and a coaxial outer cylinder in surrounding spaced relation to the inner cylinder so as to provide a chamber therebetween and wherein said chamber is adapted for receipt of a heat exchange fluid, said inner cylinder having a plurality of first pins affixed thereto and radially outwardly extending into said chamber to a point spaced from the inner surface of said outer cylinder, said outer cylinder having a plurality of second pins affixed thereto and radially inwardly extending into said chamber to a point spaced from the outside surface of said inner cylinder, said first and second pins arranged so as to be both circumferentially and longitudinally spaced from each other, and means for rotating said inner cylinder with respect to said outer cylinder whereby the movement of said first pins past said second pins and said outer cylinder churns and agitates said fluid so as to generate frictional heat in turn absorbed by said fluid and said outer cylinder.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 1 is an elevational view of the device of the present invention;

FIG. 2 is a sectional view taken along the line 2—2 of FIG. 1 and better showing the overall construction of the device;

FIG. 3 is an elevational end view taken from the left side of FIG. 1;

DESCRIPTION OF THE INVENTION

Figure 4:
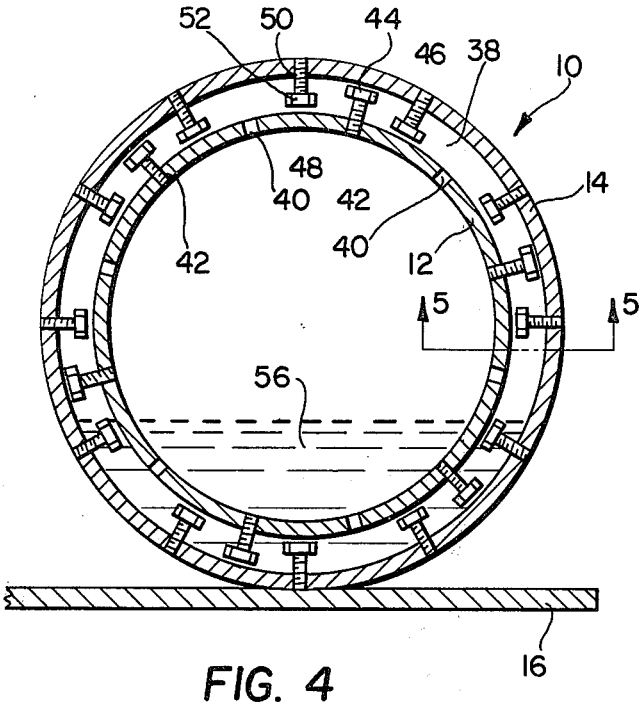
FIG. 4 is a cross-sectional view taken along the line 4—4 of FIG. 1.

As may best be seen by simultaneous reference to FIGS. 1 through 5 of the drawings, the friction heat generator or device 10 of the present invention includes spaced inner and outer cylinders 12 and 14 respectively. The outer cylinder 14 is mounted to a frame 16 by any convenient manner such as by welding and the like. The ends of the cylinder 14 are closed by front and rear end plates 18 and 20 respectively. These end plates may be affixed to the walls of the cylinder 14 by means of a plurality of threaded bolts 22. A shaft 24 is mounted in coaxial relationship with the outer cylinder 14 and is supported for rotation with respect thereto by bearings 26 supported by the end plates 18 and 20. The bearings 26 are in turn mounted in a pillow block 28 secured to the end plates 18 and 20 as by bolts 30.

The inner cylinder 12 is also of generally closed construction and includes a pair of end plates 32, which, as in the case with the outer cylinder 14, may be bolted to the cylindrical ends thereof through a plurality of threaded bolts 34. The end plates 32 in turn are provided with openings 36 through which the shaft 24 extends but unlike the outer cylinder 14, the inner cylinder 12 is fixedly attached to the shaft 24. Such attachment may be by welding the plates 32 proximal to the openings 36 therein. The spaced relationship of the inner and outer cylinders as shown in the drawings thus creates a generally closed chamber 38 therebetween.

The inner cylinder 12 is provided with a plurality of generally longitudinally oriented rows of openings 40, such rows being additionally circumferentially spaced at approximately 60° increments around the periphery of the cylinder 12. In addition to the openings 40, there are rows of similar openings 42 also disposed at approximately 60° arcuate intervals along the periphery of cylinder 12. The difference between the openings 40 and 42 is that the openings 42 are threaded so as to receive bolts 44 each having an enlarged head 46 and a threaded shaft 48. The bolts 44 thus extend radially outwardly from the outer surface of the inner cylinder 12 into the chamber 38. The enlarged heads 46 thereof are preferably disposed proximal to but spaced from the inner surface of the cylinder 14. In addition, it may be apparent that non-threaded openings 40 serve to place the interior portions of the inner cylinder 12 and the chamber 38 in fluid communication with each other. Of course the openings 40 may also be threaded for ease in construction.

Figure 5:
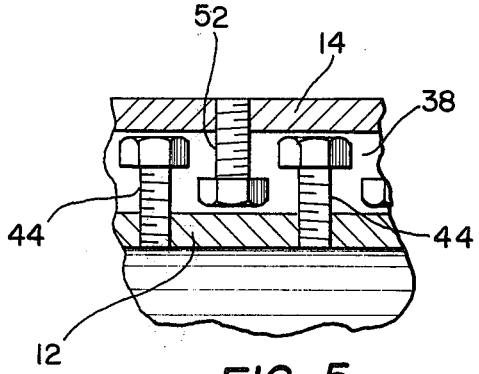
FIG. 5 is an enlarged sectional view of a portion of the device.

The outer cylinder 14 is provided with similar rows of openings 50 which are threaded so as to in turn receive a plurality of bolts 52 similar to bolts 44. The arcuate distribution of the rows of openings 50 and accordingly bolts 52 is at approximately 30° segments around the circumference of the cylinder 14. The longitudinal distribution of the rows of openings 50 are such that the bolts 52 mounted therein are longitudinally staggered with respect to the bolts 44 so as to prevent contact between them upon relative rotation of the cylinders. Thus, when viewed in a direction normal to the longitudinal plane through the cylinders such as shown in FIGS. 2 and 5, the bolts 44 and 52 are shown in spaced longitudinal relationship preferably at approximately equal intervals with respect to each other. In any event, the bolts 44 and 52 are spaced such that when the inner cylinder 12 is rotated with respect to the outer cylinder 14, the bolts 44 pass adjacent bolts 52 in close proximity thereto so as to set up agitation or churning of a heat exchange fluid 56 contained in the chamber 38. The fluid 56 is also generally free to pass into the interior portions of the cylinder 12 via openings 40, but when the inner cylinder is rotating, centrifugal force will cause the fluid to flow outwardly through openings 40 into chamber 38. Such fluid is generally a high-boiling point liquid such as linseed oil (B.P. 475°) but may include other liquids or even a gaseous fluid such as air.

Thus as the inner cylinder turns relative to the outer cylinder, the frictional action caused by the bolts passing each other and moving through the fluid 56 causes frictional heat to build up and be efficiently imparted or transferred primarily to the fluid 56 and hence to outer cylinder 14. The resultant heat generated by the above described process may then be utilized in situ as by radiation to areas surrounding the outer cylinder 14 when the unit is used as a space heater. Also, the heat may be transferred to other areas as through provision of means such as a water jacket surrounding the outside of the outer cylinder 14 through which another heat transfer fluid, such as water, then may be circulated and then pumped to an area to be heated. It should be brought out that the faster the inner cylinder 12 is rotated, the higher the build-up caused by the churning and fluid turbulence becomes.

An electrical motor 60 is mounted on the frame 16 and utilized to power the shaft 24. In this regard, the motor 60 includes a stub shaft 62 to which a pulley 64 is secured and over which a drive belt 66 is trained. The drive belt in turn is trained over another pulley 68 in turn attached to the end of the shaft 24. It should also be brought out that various other methods for turning the shaft 24 may be utilized and that the present invention is not limited to the use of an electrical motor, i.e. a gasoline or diesel engine or even water or wind power may be utilized to rotate the shaft and accordingly the inner cylinder 12 attached thereto in the desired manner. Also the device 10 may be utilized with a heat exchange fluid 56 which does not entirely fill the chamber 38. When the chamber 38 is filled to capacity, it is however particularly desirable that an expansion chamber 70 be utilized. Such expansion chamber is in communication with the chamber 38 through the end plate 18 through suitable fluid connections.

Figure 6:
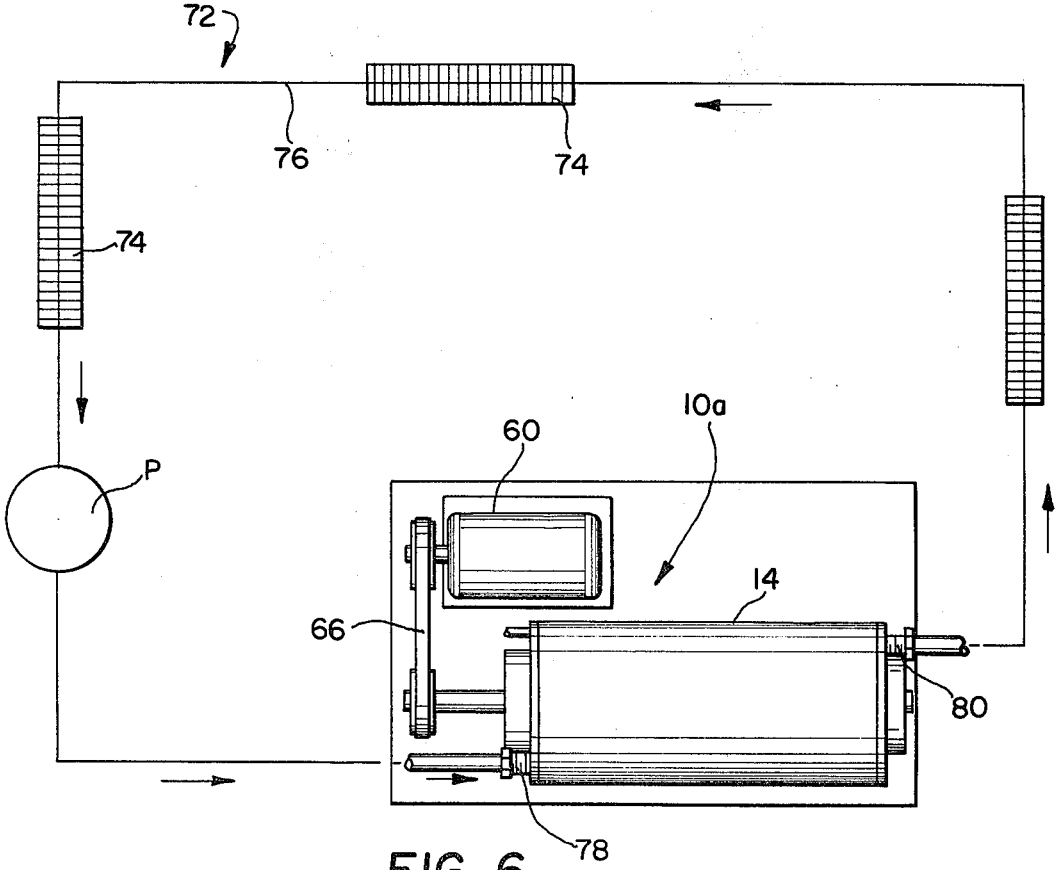
FIG. 6 is a somewhat stylized plan view similar to FIG. 2 but showing an alternate use embodiment of the invention.

Generally the cylinders 12 and 14 may be formed from cast iron, aluminum or other known materials which insures the proper distribution of heat to the fluid transfer medium. Also in some cases it may be desirable to insulate the outer surface of the outer cylinder 14 to minimize heat loss when the heat exchange fluid is circulated or pumped to a location remote from the device 10. Such a situation is shown in the embodiment of the invention illustrated in FIG. 6 where a device 10*a* is utilized as part of an otherwise conventional baseboard heating system 72. Such system includes a pump P and a plurality of radiators 74 in turn connected via appropriate conduit 76. In such systems, the heat generator 10*a* preferably utilizes water as the heat exchange fluid 56. In this regard, the friction heat generator 10*a* may be utilized to replace or augment conventionally oil or gas fired burners. To accomplish this, the front plate 18 of the outer cylinder 14 is provided with an inlet nipple 78 in turn connected to the conduit 76 and an outlet nipple 80 passing through the rear plate 20 so as to complete the circulation cycle of the system. As frictional heat is built up in the water within the chamber 38 and in the interior of the inner cylinder 12, it is pumped by means of pump P through the circulating conduit or piping system to the radiators where it serves to heat the house, office, or other generally closed environment which is desired to be heated. It will be understood that in this embodiment of my invention there is a continuous flow of fluid, such as water, through the unit 10*a*. On the other hand, a similar system to that shown in FIG. 6 could be utilized in combination with the closed unit 10 shown in FIGS. 1 and 2. Specifically, a water jacket (not shown) or other suitable heat collector could be provided around unit 10, with conduit 76 passing therethrough, whereby the heat exchange fluid, such as water, passing through the conduit would be heated.

A specific operational example of the device is as follows: an inner cylinder approximately 8½ inches long with a diameter of 6⅝ inches and a wall thickness of ⅜ inches was utilized. Bolts of ⅜ inch diameter were mounted to extend from the inside of an outer cylinder into the chamber formed between this outer cylinder and the inner cylinder in the arrangement as shown in the drawings. The slightly larger outer cylinder was provided with eighty bolts equally spaced on the inside surface thereof also as shown. The bolts were of a conventional headed type with a threaded shaft and disposed with their heads about 1/32 inch longitudinally apart so as to narrowly miss engaging each other upon rotation of the shaft and thus the inner cylinder. Enough linseed oil (at room temperature) was provided to fill chamber 38 when the shaft and inner cylinder are rotating. After rotating the shaft at 1000 rpm for a period of 45 minutes, the temperature of the linseed oil was found to be at approximately 190° F. The above described physical arrangement was also utilized but using a 1500 rpm shaft speed with the resultant temperature increase of approximately 40° F. for each 5 minute period until the temperature of the linseed oil was about 190° F.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A frictional heat generator comprising, an inner cylinder and a coaxial outer cylinder in surrounding spaced relation to the inner cylinder so as to provide a chamber therebetween and wherein said chamber is adapted for receipt of a heat exchange fluid, said inner cylinder having a plurality of first pins affixed thereto having enlarged heads at their free ends and radially outwardly extending into said chamber with said enlarged heads positioned proximal to the inner surface of said outer cylinder, said outer cylinder having a plurality of second pins affixed thereto having enlarged heads at their free ends and radially inwardly extending into said chamber with said enlarged heads positioned proximal to the outside surface of said inner cylinder, said first and second pins arranged so as to be longitudinally spaced from each other and means for rotating said inner cylinder with respect to said outer cylinder whereby the movement of said first pins past said second pins and said outer cylinder churns and agitates said fluid so as to generate frictional heat in turn absorbed thereby.

2. A frictional heat generator comprising, an inner cylinder and a coaxial outer cylinder in surrounding spaced relation to the inner cylinder so as to provide chamber therebetween and wherein said chamber is adapted for receipt of a heat exchange fluid, said inner cylinder having a plurality of first pins affixed thereto and radially outwardly extending into said chamber to a point spaced from the inner surfaces of said outer cylinder, said first pins extending proximal to the opposed surface of the outer cylinder, being generally equally longitudinally spaced and being arranged in longitudinal rows each spaced apart from each other at about 60° intervals about the periphery of said inner cylinder said outer cylinder having a plurality of second pins affixed thereto and radially inwardly extending into said chamber to a point spaced from the outside surface of said inner cylinder, said second pins extending proximal to the opposed surface of the inner cylinder being generally equally longitudinally spaced and being arranged in longitudinal rows each spaced apart from each other at about 30° intervals about the periphery of said outer cylinder, said first and second pins arranged so as to be longitudinally spaced from each other said inner cylinder including a plurality of openings arranged in longitudinally extending rows each spaced apart from each other at about 60° intervals about the periphery of said inner cylinder, said chamber and the interior of said inner cylinder being in fluid communication with each other and means for rotating said inner cylinder with respect to said outer cylinder whereby the movement of said first pins past said second pins and said outer cylinder churns and agitates said fluid so as to generate frictional heat in turn absorbed thereby.

3. The apparatus of claim 2, said pins each having enlarged heads at their free ends, said enlarged heads positioned proximal to the cylinder wall opposed thereto.

4. The apparatus of claims 1 or 3, said pins each being bolts threadably connected to their respective cylinder.

* * * * *